United States Patent [19]

Chervenak

[11] 4,191,629

[45] Mar. 4, 1980

[54] REACTOR RESIDUUM CONCENTRATION CONTROL IN HYDROCONVERSION OF COAL

[75] Inventor: Michael C. Chervenak, Pennington, N.J.

[73] Assignee: Hydrocarbon Research, Inc., Lawrenceville, N.J.

[21] Appl. No.: 955,677

[22] Filed: Oct. 30, 1978

Related U.S. Application Data

[63] Continuation of Ser. No. 740,410, Nov. 10, 1976, abandoned.

[51] Int. Cl.[2] ..... C10G 1/06

[52] U.S. Cl. ..... 208/10

[58] Field of Search ..... 208/10

[56] References Cited

U.S. PATENT DOCUMENTS

| | | | |
|---|---|---|---|
| 3,519,554 | 7/1970 | Stotler et al. | 208/10 |
| 3,519,555 | 7/1970 | Keith et al. | 208/10 |
| 3,540,995 | 11/1970 | Wolk et al. | 208/10 |
| 3,962,070 | 6/1976 | Stotler | 208/10 |
| 3,997,426 | 12/1976 | Montagna et al. | 208/10 |

FOREIGN PATENT DOCUMENTS

| | | | |
|---|---|---|---|
| 952458 | 8/1974 | Canada | 208/10 |

*Primary Examiner*—Delbert E. Gantz
*Assistant Examiner*—William G. Wright
*Attorney, Agent, or Firm*—Michael A. Jacobs

[57] ABSTRACT

A process for the hydrogenation of coal at elevated temperature is disclosed, wherein particulate coal having an average particle size of less than 1000 microns is admixed with a liquid hydrocarbon to form a slurry containing about 30–50 weight percent solids, and the slurry is passed to an ebullated bed reactor wherein the coal is catalytically hydrogenated at reactor pressure of about 100 to 300 atmospheres to produce hydrocarbon products including a liquid residuum containing unconverted processed coal solids. The improved process includes the steps of removing the hydrocarbon products from the reactor; reducing the pressure of the hydrocarbon products not more than 10% below reactor pressure to separate the hydrocarbon products by phase separation of the gaseous components from the liquid component containing residuum and unconverted coal solids; dividing the liquid into a stream for liquid-solids separation and a bypass stream; passing a portion of the liquid residuum to a liquid-solids separator at substantially the same temperature as the phase separating step; recovering from the separator a purified liquid product stream containing a substantially reduced concentration of unconverted coal solids combining a sufficient amount of the bypass stream with the solids reduced stream to maintain the desired levels of solids and residuum in the reactor; recycling the purified liquid product stream to the ebullated bed reactor in a liquid handling system wherein the pressure throughout the process is maintained at least 90% of the reactor pressure; and recovering from the cyclonic separator a second liquid product stream containing 25 to 45 weight percent unconverted coal solids.

5 Claims, 1 Drawing Figure

REACTOR RESIDUUM CONCENTRATION CONTROL IN HYDROCONVERSION OF COAL

This is a continuation of application Ser. No. 740,410, filed Nov. 10, 1976 now abandoned.

BACKGROUND OF THE INVENTION

The invention relates to an improvement in the liquid phase hydrogenation of coal utilizing an ebullated bed reactor.

The liquid phase hydrogenation of coal in an oil slurry under upflow ebullated bed reaction conditions is disclosed by Keith, et al in U.S. Pat. No. 3,519,555.

U.S. Pat. No. 3,540,955 to Wolk, et al, the disclosure of which is incorporated herein, discloses an improved process for the hydrogenation of coal wherein the composition of the liquid within the reactor is optimized by controlling the amount of liquid residuum and solids therein by removing a portion of the solids from the high residuum concentration liquid effluent prior to recycle to the reactor. The liquid residuum content of the liquid slurry within the reactor is preferably maintained in a range from about 30–45 weight percent and unconverted processed solids are maintained in amounts between about 10–25 weight percent. The aforementioned optimization is accomplished in accordance with this prior art method by flashing the liquid reactor effluent in a depressurization step to remove a gaseous component which includes unreacted hydrogen and light hydrocarbons, followed by a liquid solid separation step which is performed on the remaining high viscosity liquid stream. A stream of reduced solids concentration and residuum is then recycled back to the reaction zone for further hydrogenation and to maintain the concentration of residuum and solids within the desirable range.

Under this prior art process, the liquid solids separation step must inherently be performed at low pressures and reduced temperatures in comparison with the operating conditions in the reaction zone. Such low pressures and temperatures make removal of fine ash and unconverted coal solids from the liquid reactor effluent quite difficult because of the high viscosity of the effluent. In addition to the aforementioned disadvantages, the liquid with reduced solids content must be repressurized prior to returning to the reaction zone thereby increasing the overall costs of the process. The present invention obviates the foregoing difficulties.

SUMMARY OF THE INVENTION

The present invention provides an improved method for effectively controlling the solids concentration within the reactor in the liquid phase hydrogenation of coal by controlling the solids content in the recycle to the reactor. The solids concentration in the recycle stream is effectively controlled by phase separating the reactor effluent to remove unconsumed hydrogen and light hydrocarbons from the product liquid; which is divided into two streams, one of which is subjected to a partial removal of solids by a conventional liquid solids separator, the other being by-passed for recombination with the stream containing reduced solids concentration. By recombining the solids reduced and by-passed streams in desired proportions close control over the solids concentration within the reactor can be maintained. The remaining high solids-containing stream from the solids separator may be further processed for solids removal and to provide product liquid streams. The overall efficiency of the process, including energy saving, is enhanced by maintaining the system either at or near reactor temperature and not less than 90% of reactor pressure so as to maintain low liquid viscosity for improved solids removal and to obviate the necessity for excessive repressuration prior to recycling to the reactor.

DESCRIPTION OF THE DRAWINGS

The invention is further illustrated by reference to the accompanying FIGURE of drawing which is a schematic view of an ebullated bed coal hydrogenation process performed at near reaction zone pressure and temperature conditions.

DETAILED DESCRIPTION OF THE INVENTION

Figure 1:
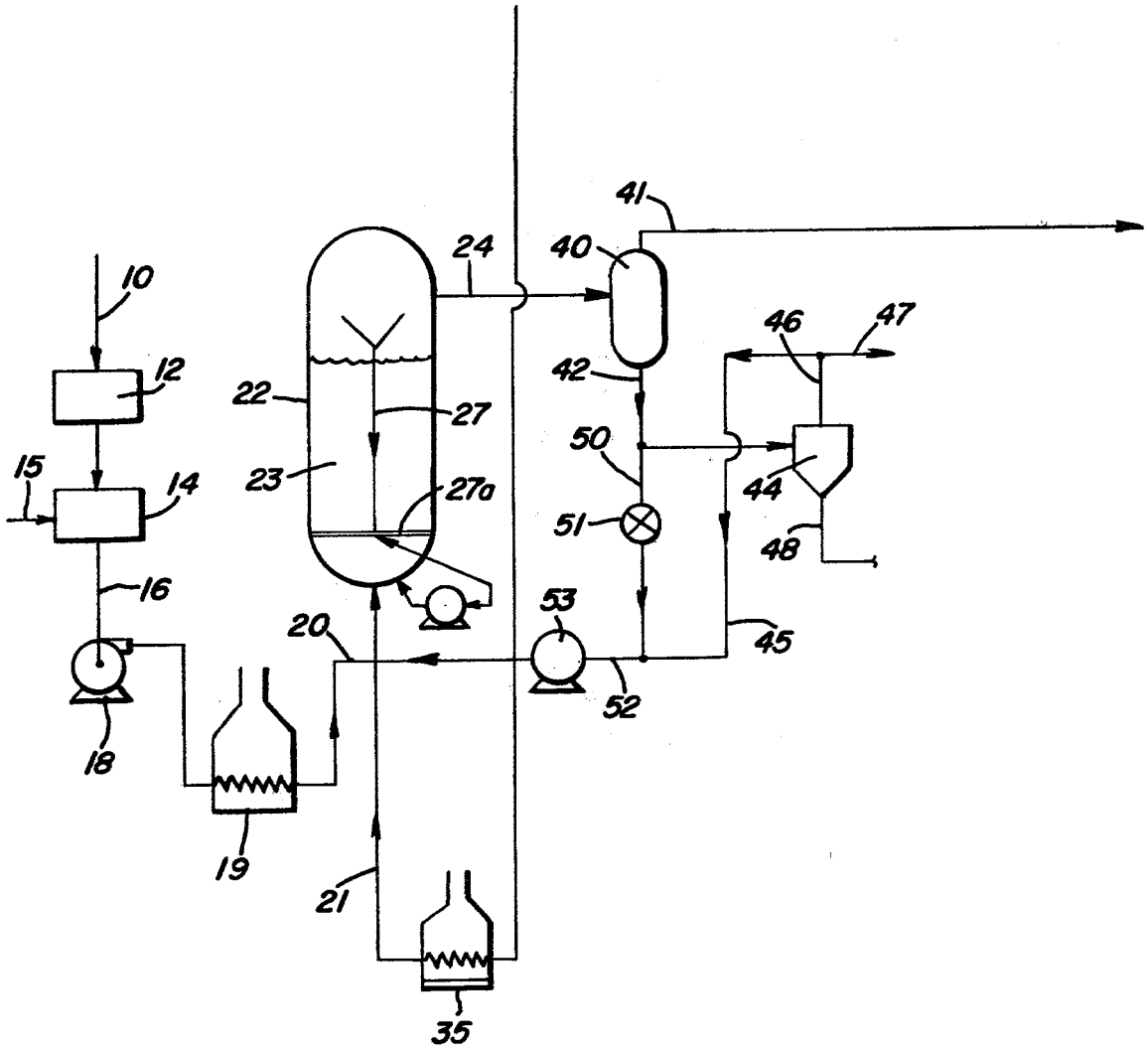

Unless stated all units are given in parts by weight and in the metric system.

A preferred overall embodiment of the invention comprises the effective hydrogenation of coal in a liquid phase ebullated bed reaction zone to produce hydrocarbon liquids and gases, subjecting a portion of the hydrocarbon liquid effluent to liquids solids separation step, and recycling a portion of the reactor liquid effluent back to the reactor, at substantially unreduced pressure and temperature conditions, so as to maintain low liquid viscosity which enhances the efficiency of the liquid solids separation step. The liquid stream recycled to the reactor should contain a desired concentration of finely divided solids, usually between 5–15 weight percent solids, which is achieved by treating at least a portion of the recycled liquid stream in a liquid-solids separation step, preferably in a liquid cyclone or hydroclone unit, to remove a significant percentage of the particulate solids therefrom, preferably 40–50 weight percent. This solids-reduced steam is then joined with a controlled amount of a by-passed stream of the normal solids concentration. A normal solids concentration stream contains the same concentration of solids as the reactor effluent. The by-passed stream usually contains 10–20 weight percent solids. The combined liquid stream having reduced concentration of solids in the desired range is then recycled to the reaction zone to provide the desired concentration of residuum and solids therein and to help maintain the catalyst bed in a satisfactory ebullated condition. The utilization of the by-pass feature for producing a combined stream of reduced solids concentration for controlling the solids concentration in the recycle liquid is particularly advantageous when the liquid solids separation operates at a highly efficient level, which would cause the solids concentration to fall below the desired level in the reactor if the solids reduced stream from the separator was only recycled. The solids-enriched or underflow stream from the solids separation step, containing an increased percentage particulate of solids may be further processed in a distillation step for removal of the light liquids, after which the remaining heavy liquid and solids are withdrawn from the system. Any portion of the reduced solids overflow liquid stream not recycled to the reaction zone is passed to a product stream.

To improve the overall process efficiency, the solids separation step is performed at near reactor pressure and temperature conditions, preferably at presures not below 90% of reactor pressure not only to minimize any undesirable flashing of vapor in the hydroclone, but also because the liquid containing solids and residuum is less viscous at high temperature which facilitates separation. The fine solid particles usually about 1–10 micron size can be removed more effectively from the liquid by centrifugal force action at a pressure not less than 90% of the ebullated bed reactor pressure. Any minor amounts of vapor evolved in the hydroclone will be insufficient to disrupt the contrifugal flow pattern or to interfere with the solids separation process. Also, less pumping power is required to recycle the high pressure liquid to the pressurized reaction zone.

Referring specifically to FIGURE 1, to more fully illustrate the various principles of this invention, coal at 10 is ground to an average particle size of less than 1000 microns and usualy dried at 12 and is then combined at 14 with a slurrying oil 15. The combined coal oil slurry stream 16 is pressurized at 18, preheated at heater 19, and introduced as stream 20 into the bottom of ebullated bed hydrogenation reactor 22 along with pressurized heated hydrogen from 21. Such reactor is of the type generally described in U.S. Re. Pat. No. 25,770, which is incorporated by reference herein, and contains particulate catalyst bed 23. The reactor is usually operated at a pressure of between 100–300 atmospheres, preferably between about 125 and 250 atomspheres. A portion of the reactor liquid is recycled from above catalyst bed 23 back through downpipe 27 and returned through distributor tray **27*a*** help maintain the bed expansion between about 10% and 150% above its settled volume. Fresh particulate catalyst can be added to the reactor and spent catalyst withdrawn therefrom using conventional procedures as desired.

In the ebullated bed reaction zone, coal having an average particle size of less than 1000 microns is hydrogenated and the total gaseous and liquid effluent is removed from the reactor as stream 24.

The total effluent stream 24 is passed to a phase separator 40 for removal of a net vapor stream including hydrogen and low boiling vapors. The net vapor may be further processed to remove a medium purity hydrogen for recycle to the reactor, and low boiling vapor may be condensed and recovered as product. The resulting liquid phase containing residuum at 42 is passed to a liquid solids separation unit 44 which is preferably a hydroclone unit operating at pressure not less than 90% of the reactor pressure. Conduit 42 should be sized so as to minimize pressure drop between separator 40 and the inlet of hydroclone 44 and thus minimize any evolution of vapor within the hydroclone unit which might reduce its solids separation efficiency. Liquid overflow stream 46 containing a reduced concentration of solids is removed from the hydroclone unit 44 and an underflow stream containing more concentrated solids is removed at 48. Also, a controlled portion 50 of the solids containing liquid effluent stream 42 is by-passed through control valve 51 and combined with portion 45 of the overflow liquid stream 46 to form liquid recycle stream 52, which is recycled by pump 53 to the bottom end of reactor 22 as previously mentioned. By controlling the flow rate of the by-pass stream 50 relative to the flow rate of overflow stream 46 the concentration of residuum and solids in the reactor is maintained within desirable ranges of about 30–45 weight percent residuum and 10–25 percent solids. The flow rates are preferably controlled so that less than 50% of the by-pass stream is utilized for the recycle. The portion of the hydroclone overflow stream 46 not recycled is removed as product stream 47. Product stream 47 may be further treated to remove remaining solids.

The primary purpose of the solids separation step at 44 is to remove sufficient particulate solids from the recycle liquid stream 52 so as to maintain the desired solids concentration of 10–25 weight percent within the ebullated bed reactor 22. The solids separation in hydroclone 44 is advantageously performed at near reactor pressure and temperature conditions so that the viscosity of the liquid is maintained relatively low and the fine particulate solids can be more readily removed from the liquid by centrifugal force action in the separation unit. The liquids solids separation step at 44 is preferably performed by a liquid cyclone or hydroclone, but any centrifugal type liquids solids separation device or any other generally recognized devices for separating finely suspended solids from liquids can be used.

We have discovered that for the by-pass liquid stream 50 containing the normal concentration of coal solids to be effectively used to achieve good operation of the ebullated bed reactor, its flow rate should preferably not exceed the flow in stream 45. For the solids separation step at 44, the flow rate of the overflow stream 46 should be about equal to the flow rate of the separator bottoms stream 48. This latter stream will usually comprise 25–45weight percent solids or near the maximum flowable amount which are passed on to other processing steps as previously mentioned.

Although in the invention has been described in terms of the accompanying diagrams and preferred embodiments, it will be appreciated by those skilled in the art that many modifications and adaptations of the process are possible within the spirit and scope of the invention which is defined by the claims below.

We claim:

1. In a process for the hydroconversion of coal at elevated temperatures wherein a particulate coal having an average particle size of less than 1,000 microns is admixed with a hydrocarbon liquid to form a slurry containing about 30–50 weight percent solids, which is passed with hydrogen upwardly through an ebullated reaction zone wherein the coal is catalytically hydrogenated at reactor pressure conditions of about between 100–300 atmospheres to produce liquid and gaseous hydrocarbon products including a liquid residuum containing unconverted process solids, wherein said reaction zone liquid is maintained with a liquid residuum content of about 30–45 weight percent and unconverted process solids of between 10–25 weight percent by recycling a portion of the liquid product, the improvement which comprises:

(a) passing the hydrocarbon products to a phase separator operating under conditions of pressure not less than 90% of reactor pressure, and temperature conditions near reactor temperature for separation of gaseous hydrocarbons from liquid product;

(b) dividing a portion of the liquid product stream into a first stream for solids separation and a second stream for by-pass;

(c) passing the first stream without further separation to a solids separation zone maintained substantially at reactor temperatures and pressure conditions not less than 90% of reactor pressure, whereby a portion of the solids are removed thereby forming a liquid stream containing reduced solids concentration and a stream of increased solids concentration;

(d) recovering the stream of increased solids concentration;

(e) blending the second liquid stream with a sufficient amount of the solids reduced liquid stream to form a combined liquid recycle stream containing between 5–15 weight percent solids;

(f) passing the solids reduced combined liquid stream to the reaction zone thereby maintaining the solids concentration in the reactor zone liquid between about 10–25 percent;

(g) recovering the portion of the reduced solids concentration stream not recycled; and (h) recovering the converted product.

2. The process of claim 1, wherein the solids separation zone is a hydroclone.

3. The process of claim 1, wherein the reactor pressure is maintained at about 125 atmospheres and wherein the liquid solid separator is maintained at a pressure of at least 125 to 180 atmospheres.

4. The process of claim 1, wherein the solids content of the combined recycle stream is maintained between about 5–15 weight percent by maintaining the flow rate of the by-pass stream not in excess of the flow rate of the solids reduced stream.

5. The process of claim 4, wherein the flow rate of the by-pass stream is maintained at a level less than 50% of the solids reduced stream.

* * * * *